US009295896B1

(12) United States Patent
Hoang

(10) Patent No.: US 9,295,896 B1
(45) Date of Patent: Mar. 29, 2016

(54) WEARABLE GOLF TRAINING AIDS

(71) Applicant: Ben Hoang, Calgary (CA)

(72) Inventor: Ben Hoang, Calgary (CA)

( * ) Notice: Subject to any disclaimer, the term of this patent is extended or adjusted under 35 U.S.C. 154(b) by 0 days.

(21) Appl. No.: 14/792,353

(22) Filed: Jul. 6, 2015

(51) Int. Cl.
*A63B 69/36* (2006.01)
*A63B 69/00* (2006.01)
*A63B 71/06* (2006.01)

(52) U.S. Cl.
CPC ..... *A63B 69/3608* (2013.01); *A63B 69/0059* (2013.01); *A63B 71/0619* (2013.01); *A63B 2208/0204* (2013.01)

(58) Field of Classification Search
USPC ..... 473/207, 208, 212, 215, 216, 257, 266, 473/274, 277; 482/10, 51, 109, 110; 602/5, 602/17–19, 32, 36
See application file for complete search history.

(56) References Cited

U.S. PATENT DOCUMENTS 2,611,610 A * 9/1952 Hara ..... A63B 69/0059 473/257
3,346,257 A * 10/1967 Whitney ..... A63B 69/0059 434/252
4,318,546 A * 3/1982 Chen ..... A63B 69/3608 473/216
5,435,563 A * 7/1995 Salvatore ..... A63B 69/0059 128/870
5,803,838 A * 9/1998 DeMarini ..... A63B 21/0088 244/142
5,868,691 A * 2/1999 Vishnevsky ..... A61F 5/026 128/845
2006/0287122 A1* 12/2006 Ray ..... A63B 69/3638 473/228

* cited by examiner

*Primary Examiner* — Nini Legesse
(74) *Attorney, Agent, or Firm* — Fish & Richardson P.C.

(57) ABSTRACT

A golf training device is disclosed that can include a shoulder harness, a waist harness, a torsion bar, a shoulder turn regulator, and a hip turn regulator. The torsion bar can extend vertically from the upper back to the lower back or the waist area of the wearer of the golf training aid. The shoulder turn regulator can connect between the shoulder harness and an upper end of the torsion bar, and can resist rotation of the shoulders of the wearer of the golf swing training aid beyond a threshold shoulder rotation amount during a backswing motion of the wearer. The hip turn regulator can connect between the waist harness and a lower end of the torsion bar, and can resist rotation of the hips of the wearer of the golf swing training aid beyond a threshold hip rotation amount during the backswing motion of the wearer.

22 Claims, 12 Drawing Sheets

WEARABLE GOLF TRAINING AIDS

TECHNICAL FIELD

The subject matter of this disclosure relates to golf training aids.

BACKGROUND

Golf is a popular sport played by many people around the world of all ages and skill levels. While golf can be enjoyed by anyone, golf is nevertheless a game of skill that requires practice and repetition to reach one's potential. Indeed, the pursuit of lower scores through improved swing mechanics and better "touch" or "feel" for the game is one of the most gratifying aspects of golf. Golfers work on their games in a number of ways such as playing frequent rounds of golf, spending time at the driving range and short-game practice areas, reading literature regarding swing mechanics and mental strategies, and receiving lessons from experienced golfers and golf professionals. Some golfers' practice is facilitated by various training aids that encourage, for example, proper swing mechanics.

SUMMARY

The subject matter of this disclosure relates to golf training aids. In general, in one aspect, a golf training device is disclosed that includes a shoulder harness, a waist harness, a torsion bar, a shoulder turn regulator, and a hip turn regulator. The shoulder harness can be adapted to extend laterally across an upper back of a wearer of the golf training aid from a left shoulder of the wearer to a right shoulder of the wearer (such as for example for use by a right handed golfer). The waist harness can be adapted to extend laterally across a lower back or waist area of the wearer from a left side of the wearer to a right side of the wearer. The torsion bar can be adapted to extend vertically from the upper back to the lower back or the waist area of the wearer of the golf training aid. The shoulder turn regulator can be connected to a portion of an upper end of the torsion bar, and can be adapted to resist rotation of the shoulders of the wearer of the golf swing training aid beyond a threshold shoulder rotation amount during, for example, a backswing motion of the wearer. The hip turn regulator can be connected to a portion of a lower end of the torsion bar, and can be adapted to resist rotation of the hips of the wearer of the golf swing training aid beyond a threshold hip rotation amount during, for example, the backswing motion of the wearer.

Embodiments of the subject matter can include one or more of the following features.

The torsion bar can include a first portion and a second portion. The first portion of the torsion bar can be adapted to rotate in conjunction with rotation of the shoulders of the wearer. The second portion of the torsion bar can be adapted to rotate in conjunction with rotation of the hips of the wearer. The first and second portions can be arranged to rotate separately from each other.

The first portion of the torsion bar can include a first elongated tube. The second portion of the torsion bar can include a second elongated tube. The torsion bar can further include an outer tube adapted to receive the first elongated tube and the second elongated tube at respective ends of the outer tube. The first elongated tube and second elongated tube can each be rotatably coupled to the outer tube.

The shoulder harness can include a substantially rigid bar adapted to extend across the upper back of the wearer of the golf training aid. The rigid bar of the shoulder harness can be shaped to arc across the upper back of the wearer of the golf training aid.

The waist harness can include a substantially rigid bar adapted to extend across the lower back or waist area of the wearer of the golf training aid. The rigid bar of the waist harness can be shaped to arc along the lower back or waist area of the wearer golf training aid.

The shoulder turn regulator can be adapted to resist rotation of the shoulders of the wearer of the golf training aid beyond a threshold shoulder rotation amount in a range of approximately 80 to 110 degrees from an initial setup position.

The shoulder turn regulator can include a user-selectable control adapted to adjust the threshold shoulder rotation amount to a particular amount within the range based on user input.

The hip turn regulator can be adapted to resist rotation of the hips of the wearer of the golf swing training aid beyond a threshold hip rotation amount in a range of approximately 25 to 45 degrees from an initial setup position.

The hip turn regulator can include a user-selectable control adapted to adjust the threshold hip rotation amount to a particular amount within the range based on user input.

The hip turn regulator can be adapted to resist rotation of the hips of the wearer of the golf training aid beyond a first angle, the shoulder turn regulator can be adapted to resist rotation of the shoulders of the wearer of the golf training aid beyond a second angle, and the first angle can be at least approximately ten degrees less than the second angle.

The shoulder turn regulator can be adapted to generate feedback, e.g., haptic feedback or audible feedback, to the wearer of the golf training aid as a result of the wearer rotating the shoulders beyond the threshold shoulder rotation amount.

The hip turn regulator can be adapted to generate feedback, e.g., haptic feedback or audible feedback, to the wearer of the golf training aid as a result of the wearer rotating the hips beyond the threshold hip rotation amount.

The training aid can include one or more light sets adapted to be worn by the wearer of the golf training aid while performing a golf swing. Each of the one or more light sets can include at least one light source arranged (i) to direct light to a particular location on a ground surface around the wearer that indicates the wearer is in a proper setup position for the golf swing, and (ii) to direct light along a pre-defined path of the ground surface during performance of the golf swing, wherein the pre-defined path is arranged to encourage proper swing mechanics of the wearer.

A first light set of the one or more light sets can include a string of multiple light emitting diodes (LEDs) or lasers, spaced over a distance and adapted to be attached to an outer surface of the wearer of the golf training aid.

Different ones of the one or more light sets can include light sources having visibly different colors, so as to allow the wearer to distinguish among different light sets based on the respective colors of the light sources.

A first light set of the one or more light sets can be adapted to fit around a knee of the wearer, along a clavicle of the wearer, around a head of the wearer, or around the waist area of the wearer during performance of a golf swing.

A second light set of the one or more light sets can be adapted to attach along a shaft of a golf club, along a leading arm of the wearer, or along a trailing arm of the wearer during performance of a golf swing.

The training aid can further include a head restriction device adapted to be worn during execution of a golf swing by the wearer to maintain the head of the wearer in proper position during the execution of the golf swing. The head restriction device can include a first guide element shaped to curve over a top of the wearer's head, a second guide element shaped to curve around a side (e.g., the left-side) of the wearer's head, and a third guide element shaped to curve around an opposite side (e.g., a right-side) of the wearer's head.

The training aid can further include a swing plane guide having a first end and a second end, the first end adapted to connect to a shaft of a golf club, the second end adapted to connect to a structure, e.g., attached or mounted on the back of the wearer. The structure on the back of the wearer can be positioned so that the swing plane guide defines a golf swing plane.

Embodiments of the disclosed subject matter can realize none, one or more of the following advantages. The training device can be easily adjusted to fit any size user, to allow golfers of all skill levels to work either independently or with an instructor to learn the proper positions and sequence of motions of a golf swing. The training device can be deployed for either right-handed or left-handed golfers. The training device can be easily deployed or disassembled for compact storage. For example, the components of the training device can be made to fit within a pouch or other compartment of a standard golf club bag so that the device may be readily accessible wherever the user travels with his/her golf bag and clubs.

BRIEF DESCRIPTION OF THE DRAWINGS

Like reference symbols in the various drawings indicate like elements.

DETAILED DESCRIPTION

The subject matter of this disclosure generally relates to golf swing training aids for promoting desirable swing mechanics. A golf swing is a complicated motion that involves many moving parts of the golfer's body. The greater ability that a golfer has to repeatedly deliver clean, powerful strikes to a golf ball will generally allow him or her to play better golf and lower scores. One important aspect of a consistent, reliable golf swing is the proper timing and sequencing of various sub-motions involved in the golf swing. For example, the takeaway of the club from an initial position, and the rotation of the golfer's hips and shoulders should occur in a sequence that maximizes the power build-up of the swing, while also placing the golfer's body and club in positions that ensure reliable, consistent ball strikes. The swing training aids described herein may be worn by a golfer to facilitate the golfer's proper setup position before a golf swing. The training aids may also promote desirable timing, sequence, and magnitude of the golfer's hip and shoulder rotations, and the proper positioning of the golfer's body and club throughout the swing execution.

Figure 1A:
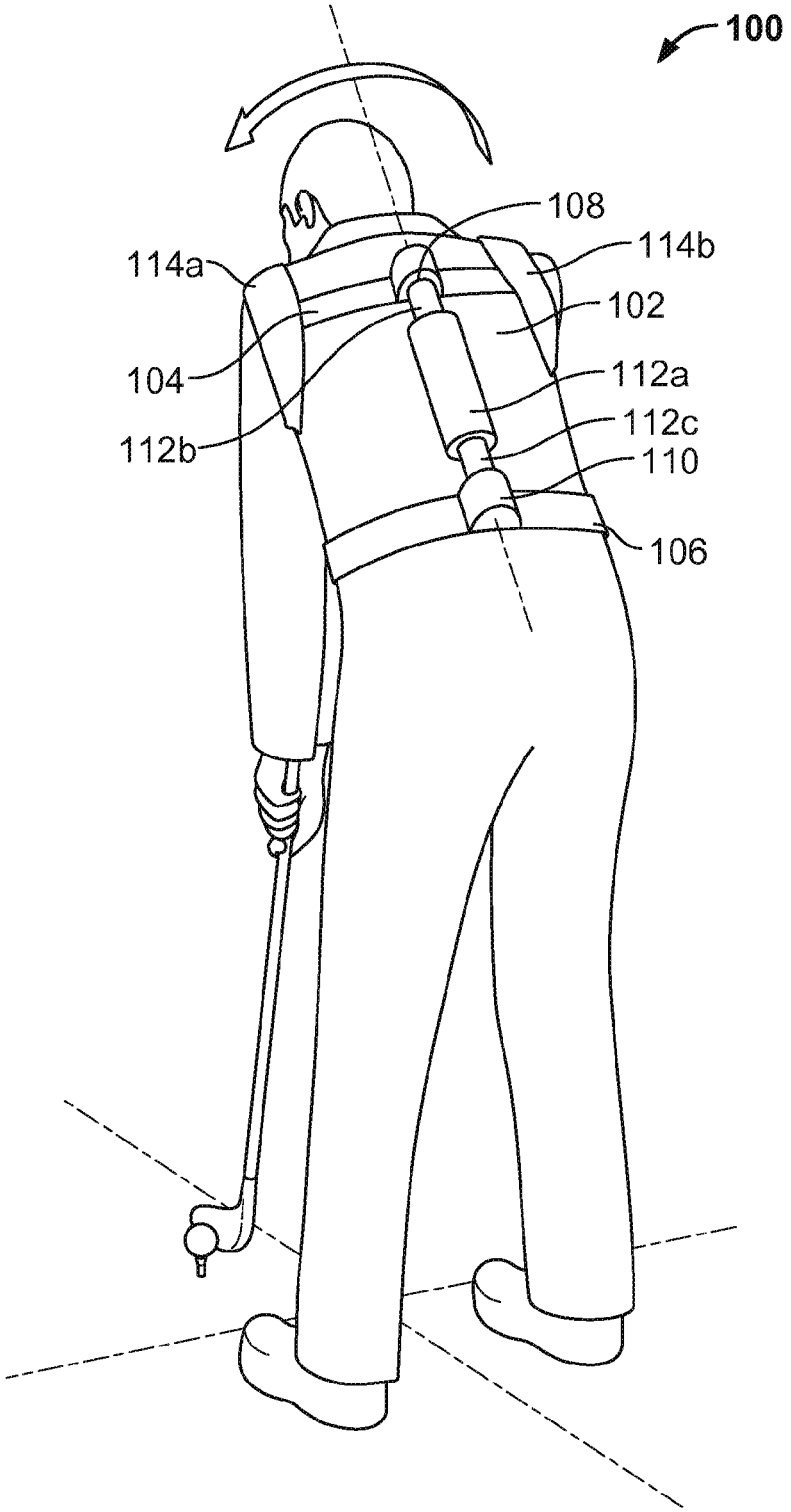
FIG. 1A shows an example swing training aid for regulating a golfer's shoulder and hip turns during a golf swing.
Figure 1B:
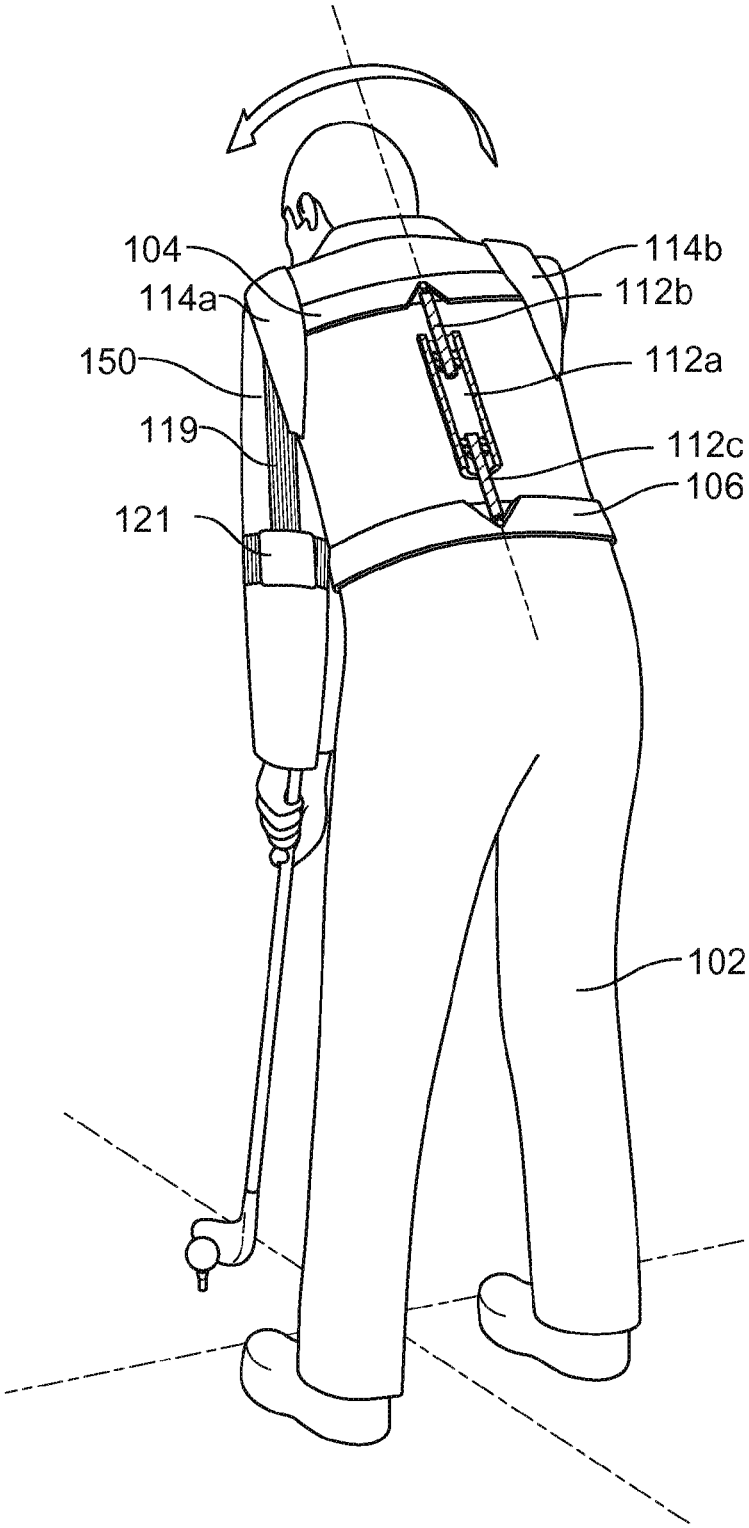
FIG. 1B shows an example of the swing training aid from FIG. 1A, along with an optional arm assembly for use in the swing training aid. A cross-sectional view of the torsion bar is shown on the back of the golfer.
Figure 1C:
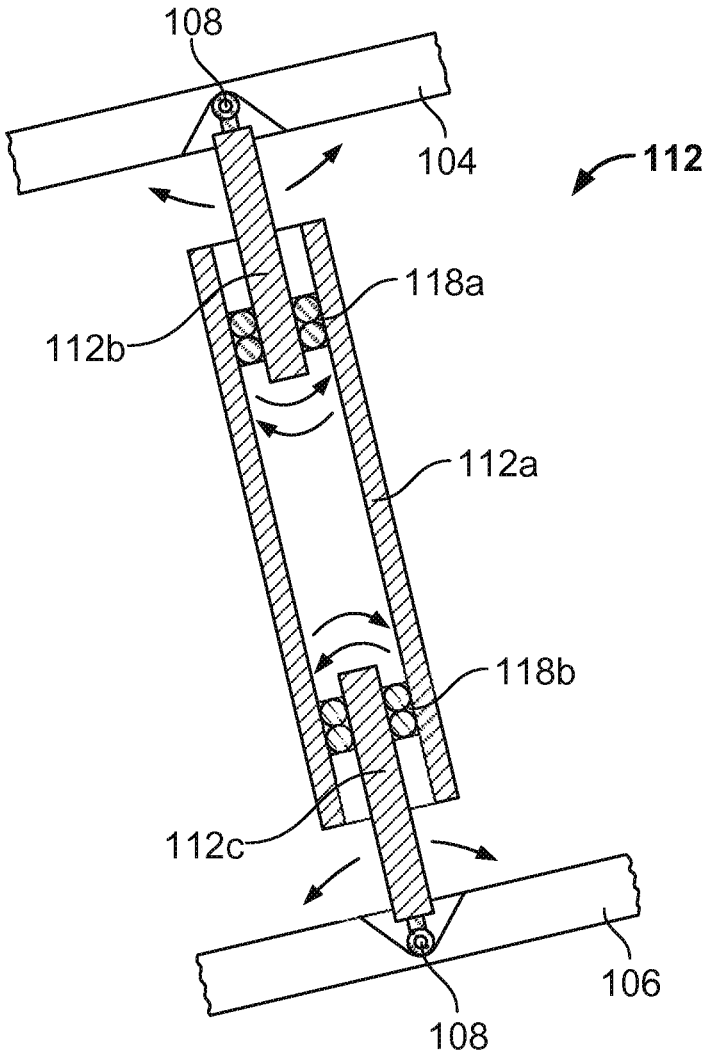
FIG. 1C is a cross-sectional representation of the torsion bar used in the golf swing training aids of FIGS. 1A and 1B.

Referring now to FIGS. 1A-1C, an example swing training aid 100 is shown for regulating a golfer's shoulder and hip turns during a golf swing. The training aid 100 can include a shoulder harness 104, a waist harness 106, a first connector assembly 108, a second connector assembly 110, and a torsion bar 112 (including portions 112*a*, 112*b* and 112*c*). The swing training aid 100 can provide various forms of feedback to the golfer 102 that encourages the golfer 102 to make a full turn with the hips and shoulders during a backswing. One problem that many golfers experience with their swings is the failure to make a full hip and shoulder turn when taking the club back during a swing. Without a full turn and weight shift to the trailing leg (e.g., the right leg for a right-handed golfer) in the backswing, golfers may not sufficiently wind into a position that maximizes the power that can be delivered to the ball during the forward swing. The swing training aid 100 is adapted to promote a full hip and shoulder turn, while also discouraging the golfer 102 from over-turning, which can also be detrimental to an efficient and reliable golf swing.

When donned by the golfer 102, the training aid 100 may generate resistance that deters the golfer 102 from rotating his or her hips or shoulders beyond a threshold amount. During the backswing, the training aid 100 allows the golfer 102 to continue turning his or her hips until the golfer 102 is fully rotated. Upon reaching a full rotation, the training aid 100 may resist further rotation, or may provide other feedback such as audible indications or haptic feedback that signal to the golfer that a full rotation has been achieved, and that he or she may then begin the downswing.

In some implementations, the training aid 100 can be configured so that the shoulder harness 104 and the waist harness 106 each rotates relative to the torsion bar 112 or relative to a portion of the torsion bar 112. The shoulder harness 104 is adapted to extend laterally across the user's upper back in the shoulder region. To secure the shoulder harness 106 to the golfer 102, shoulder straps 114*a-b* can be provided at the ends of the shoulder harness 104. The golfer 102 may slide a first shoulder strap 114*a* up his or her left arm (leading arm for a right-handed golfer), and over the left shoulder. Likewise, the second shoulder strap 114*b* can slide up the golfer's 102 right arm (trailing arm for a right-handed golfer), and over the right shoulder. Opposite ends of a substantially rigid shoulder bar (e.g., a portion of the shoulder harness 104) that extends across the golfer's back may be attached to the first and second shoulder straps 114*a-b*, respectively. In some implementations, the shoulder straps 114*a-b* (and other straps in the training aid 100) may be made of a flexible, elastic material such as a woven cloth, or real or synthetic rubber. In order to maintain sufficient tension to support the shoulder harness 104 (which may be provided in the form of a lateral bar across the user's back in the shoulder region), the shoulder straps 114*a-b* may be connected across the front of the golfer 102, and pulled tight to a desired tension. In some implementations, the shoulder straps 114*a-b* may be a part of the shoulder harness 104, and may even be integrally formed with one or more portions of the shoulder harness 104.

A lateral bar of the shoulder harness 104 (i.e., the portion of the shoulder harness that spans the upper back of the golfer 102 transverse to the golfer's spine) may be made of a substantially rigid material, such as a hard plastic or metal. To reduce its weight, the lateral bar of the harness 104 may be made of a lightweight class of materials, such as aluminum or polyvinyl chloride (PVC).

In some implementations, the amount of shoulder turn performed by the golfer 102 during the backswing may be measured as the angle that the shoulder harness 104 (or a portion of the shoulder harness 104) turns about an axis transverse to a plane defined by the user's back when addressing the golf ball in a proper golf stance. At address (before initiating the swinging motion), the angle of the lateral shoulder harness 104 may be between 0-15 degrees from horizontal, for example, if the leading shoulder of the golfer is lowered relative to the trailing shoulder. At the top of the backswing, the shoulder angle, and the angle of the shoulder bar, may be between substantially 80 and 110 degrees, for example.

The shoulder harness 104 may be coupled to the torsion bar 112. The torsion bar 112 is adapted to span the space between the shoulder harness 104 and the waist harness 106. A top end of the torsion bar 112 may be coupled to the shoulder harness 104, while the bottom end of the torsion bar 112 may be coupled to the waist harness 106. In some implementations, the torsion bar 112 may resist the golfer's rotation during execution of backswing. The resistance may initially be relatively minor, but may become increasingly more pronounced as the user reaches and exceeds a maximum turning angle. In some implementations, the torsion bar 112 may not resist rotation until the golfer 102 reaches a preset maximum turning angle, or an angle near the maximum. The torsion bar 112 may also vibrate, generate an audio cue, or both, when the user reaches the maximum turning angle of the hips, shoulders, or both. The torsion bar 112 may also detect how much hip turn, shoulder turn, or both that the golfer performs during a swing, and may output a signal to a computer that records data about the user's swing, including the amount of hip turn, shoulder turn, or both, for example. The data may also be recorded in a storage device within the torsion bar 112 in some examples.

The torsion bar 112 may include a central portion 112*a*, and an upper portion 112*b*, and a lower portion 112*c*. The upper portion 112*b* may be coupled to the shoulder harness 104, so that when the golfer 102 rotates his shoulders, the rotational motion of the shoulder harness 104 causes the upper portion 112*b* of the torsion bar 112 to rotate by an amount that corresponds to an angle of rotation of the shoulder harness 104. The lower portion 112*c* may be coupled to the waist harness 106, so that when the golfer 102 rotates his hips during the backswing, the movement of the waist harness 106 causes the lower portion 112*c* of the torsion bar 112 to rotate by an amount that corresponds to an angle of rotation of the waist harness 106. In some implementations, the upper and lower portions 112*c-c* of the torsion bar 112 may be tubes, which are received within a larger diameter tube of the torsion bar's central portion 112*a*.

FIGS. 1B and 1C show additional detail of one implementation of the torsion bar 112. In particular, FIG. 1B shows a cross-sectional illustration of the torsion bar 112 worn by the golfer, and FIG. 1C shows a cross-sectional illustration of the torsion bar 112 in a closer view. In these figures, the upper and lower portions 112*b-c* of the torsion bar 112 are disjointed, as the upper portion 112*b* is separate from the lower portion 112*c*. In this arrangement, the upper portion 112*b* and lower portion 112*c* are capable of rotating independently of each other. Therefore, the upper portion 112*b* can advantageously rotate a different amount than the lower portion 112*c*, as when the shoulder rotation is greater than the hip rotation for example. Being as the upper and lower portions 112*b-c* are disconnected from each other, rotation of one portion may not cause rotation of the other portion. The central portion 112*a* may be secured to the golfer in such a way as to prevent the central portion from both moving along the golfer's back, and from rotating on the golfer's back during a swing. For example, the central portion 112*a* may have a flattened surface (not shown) that abuts the back of the golfer and that serves to resist rotation of the central portion 112*a* on the golfer's back. In some implementations, one or more stabilizing arms or tabs (not shown) may extend laterally from the central portion 112*a*, and may press against the golfer's back to fix the central portion 112*a* in place and prevent rotation during a swing.

As shown in FIG. 1C, when disjointed, the upper and lower portions 112*b-c* can each be formed as shafts (e.g., rods or tubes) that are received at opposite ends within an elongated bore of central portion 112*c*. The bore of central portion 112*c* may have regulators 118*a-b* that secure the upper portion (shaft) 112*b* and lower portion (shaft) 112*c* within the central portion 112*c* of the torsion bar 112. In some implementations, the regulators 118*a-b* may respectively allow the upper and lower portions 112*b-c* to rotate within the regulators 118*a-b* (and thus to rotate relative to the central portion 112 as well). For example, the regulators 118*a-b* may include bearings, such as ball-bearings or sleeve bearings, having an outer race fixed to a wall (or slightly recessed in a channel) of the bore of the central portion 112*c* of the torsion bar 112. The upper or lower portion 112*b-c* may then be coupled to an inner race of the bearing to allow for rotation. In some implementations, the regulators 118*a-b* may provide resistance that requires the golfer to exert additional effort to rotate the upper and/or lower portions 112*b-c* of the torsion bar 112 within the central portion 112*a*. The structures may also be locked in one or more variable positions to assist the golfer in locating and holding different rotational positions in swing. The upper regulator 118*a* may be a shoulder turn regulator that resists rotation of the shoulders of the golfer 102 beyond a threshold shoulder rotation amount during a backswing motion of the wearer. The lower regulator 118*b* may be a hip turn regulator that resists rotation of the hips of the wearer of the golf swing training aid beyond a threshold hip rotation amount during the backswing motion of the wearer.

In some implementations, the central portion 112*c* of torsion bar 112 may be configured to allow the shafts of the upper and lower portions 112*b-c* to compress and extend longitudinally within the central portion 112*c*. For example, one or more springs may be located in the bore of the central portion 112*c*. The springs may be biased so as to push the upper and lower portions 112*b-c* out into an extended position. As the golfer performs a swing, the upper and lower portions 112*b-c* may compress and de-compress along a longitudinal axis of the torsion bar so that the overall length of the torsion bar 112 varies during the swing.

In some implementations, the upper and lower portions 112*b-c* may be only partially disjointed so that, even though the respective portions 112*b-c* may not rotate at the same rates or by the same amounts, torsion resulting from the rotation of one of the portions 112*b-c* tends to cause the other of the portions 112*b-c* to rotate as well. For example, if the golfer 102 begins a backswing by rotating his shoulders, thereby causing rotation of the torsion bar's upper portion 112*b*, but fails to sufficiently rotate his hips, then the rotation of upper portion 112*b* may result in the application of a rotational force to the lower portion 112*c* of the torsion bar 112, in a manner that encourages the golfer 102 to begin turning his or her hips more. Such connection between the upper and lower portions 112*b-c* of the torsion bar 112 may thus prevent the golfer 102 from excessively separating the shoulder and hip rotations during a backswing. The training aid 100 can thereby use a golfer's natural shoulder rotation to promote greater hip rotation, and may similarly use the golfer's natural hip rotation to promote additional shoulder rotation. Partially disjointed upper and lower portions 112*b-c* may be implemented in various ways. In one example, the upper and lower portions 112*b-c* may be connected in an assembly that transfers only a portion of the torque and/or rotational amount between the different respective portions 112*b-c* of the torsion bar 112. In another example, the upper and lower portions 112*b-c* may be formed as an integral, elongated piece that is capable of twisting when opposing forces apply torque in different directions at the upper end (upper portions 112*b*) and lower end (lower portion 112*c*) of the integral, elongated piece. The integral piece may be formed of a polymer or soft metal piece, for example. In yet another example, upper and lower portions 112*b-c* may be physically separate, similar to what is shown in FIG. 1C, but their actions may be coupled by one or more electronic controllers that detect the torque and rotation applied to each portion 112*b-c*, and that cause a corresponding torque and rotation to be applied to the other one of the portions 112*b-c*. There may be a direct, 1:1 correspondence between the rotation and/or torque of the upper and lower portions 112*b-c*, or a different ratio (e.g., 2:1) or other correspondence may apply (e.g., the controller may only begin applying torque to the lower portion 112*c* after the upper portion 112*a* has rotated a threshold amount).

In some implementations, the torsion bar 112 may be connected to the shoulder harness 104 and the waist harness 106, respectively, by way of connector assemblies 108, 110. The first connector assembly 108 is operable to connect the upper portion 112*b* of the torsion bar 112 to the shoulder harness 104. The second connector assembly 108 is operable to connect the lower portion 112*c* of the torsion bar 112 to the waist harness 106. Depending on the particular implementation of the torsion bar 112, the connector assemblies 108, 110 may provide either rotatable or substantially fixed (non-rotatable) connections between the upper and lower portions 112*b-c* and the shoulder and waist harnesses, respectively. For example, a ball-and-socket joint or other type of swiveling mechanism may be employed when a rotatable connection is desired. In this way, the shoulder harness 104 may rotate about the upper portion 112*b*, and the waist harness 104 may rotate about the lower portion 112*c*. In some implementations, clips or other types of locking mechanism may be employed to create fixed connections in which the upper and lower portions 112*b-c* of the torsion bar 112 respectively are received into cavities on the shoulder harness 104 and waist harness 106. The clips, or other locking mechanisms, may prevent the shoulder harness 104 from rotating about the upper portion 112*b* of the torsion bar 112, and may prevent the waist harness 105 from rotating about the lower portion 112*c* of the torsion bar 112. Because of the fixed connections, rotation of the shoulder harness 104 causes the upper portion 112*b* of the torsion bar 112 to make a corresponding rotation within the central portion 112*a* of the torsion bar 112. Similarly, the fixed connection made by connector assembly 110 causes the lower portion 112*c* of the torsion bar 112 to make a corresponding rotation within the central portion 112*a* of the torsion bar.

In some implementations, the regulators 118*a-b* within the central portion 112*a* of the torsion bar 112 may include sensors that detect an amount of the golfer's 102 shoulder turn or hip turn, respectively. For example, the lower one of the receiving structures 118*b* may be configured to activate one or more events when the amount (angle) of the golfer's hip turn during a golf swing is determined to meet at least a preset threshold hip turn amount. The upper one of the structures 118*a* may be configured to activate one or more events when the amount (angle) of the golfer's shoulder turn during the swing is determined to meet at least a preset threshold shoulder turn amount.

In some implementations, the shoulder turn regulator 118*a* and hip turn regulator 118*b* may activate resistance (creating a resistance event) when the golfer's shoulder or hip turn respectively meets the threshold turn amounts. When resistance is activated, the regulators 118*a-b* can "brake" the backswing motion of the golfer 102, making it more difficult for the golfer 102 to continue his or her hip and shoulder turns. The regulators 118*a-b* may "lock" upon reaching maximum turn angles so that the shoulder harness 104 is prevented from rotating any further with respect to the torsion bar 112. In some implementations, rather than locking, the regulators 118*a-b* may apply resistance that the golfer 102 can continue to move through, albeit with greater force than before the resistance was applied. The resistance applied by the regulators 118*a-b*, whether fully locked or not, can provide feedback to the golfer that indicates when a full shoulder or hip turn has been completed. The golfer 102 should continue to rotate the hips and shoulders until the regulators 118*a-b* generate resistance, or generate another form of feedback, indicating that a full turn has been accomplished.

In some implementations, the training aid 100 may generate other modes of feedback that indicate information about shoulder turn and hip turn to the golfer 102 during a swing. The other feedback modes may be generated in addition to the resistive feedback, or may be generated alternatively to resistive feedback. For example, a beep, chime, tonal sequence, or other sound may be generated (e.g., with a speaker) when a portion or a full shoulder turn has been made, and also when a portion or full hip turn has been made. In some implementations, the feedback provided by the shoulder turn regulator 118*a* may not be the same as the feedback provided by hip turn regulator 118*b*. The differences in feedback can help the golfer 102 to distinguish when he or she has completed the hip turn versus the shoulder turn, as well as the sequence and timing of the two completions. For example, to ensure that the golfer 102 completes at least a threshold level of hip rotation before the shoulder rotation is completed, the golfer 102 can listen for a low pitch tone indicating completion of the hip rotation, and then listen for a high pitch tone indicating completion of the shoulder rotation. If the high pitch tone occurs before the low pitch tone, the golfer 102 may recognize that his or her movements in the backswing are not in proper sequence.

In some implementations, the swing training aid 100 may include one or more controls that allow a user to select and adjust various settings of the swing training aid 100. The controls may be electronic controls that the golfer 102 may interact with through a user interface displayed on a small LCD screen on the training aid 100, for example. In some implementations, the controls may be mechanical controls, such as dials, knobs, or buttons that the golfer 102 may select on the regulators 108, 110, torsion bar 112, or other component of the training aid 100. A first control may allow the golfer 102 to set the threshold shoulder rotation angle, which is the angle at which a full shoulder rotation is deemed completed. The control may provide a range of angles that the golfer 102 may select from, such as 80-110 degrees. For example, a certified golf instructor may inform the golfer 102 that his or her ideal shoulder turn should be about 105 degrees. The golfer 102 may then set the threshold shoulder rotation angle on the training aid to 105 degrees. A second control may allow the golfer 102 to set the threshold hip rotation angle, which is the angle at which a full hip rotation is deemed completed. The control may provide a range of angles that the golfer 102 may select from, such as 25 to 45 degrees, or 25-65 degrees. As with the threshold shoulder rotation angle, the golfer 102 may set the threshold hip rotation angle to a particular value within the applicable range (e.g., 35 degrees).

In some implementations, the training aid 100 may include a third control for adjusting the amount of shoulder turn resistance that is to be applied when the golfer 102 reaches the threshold shoulder rotation angle. A fourth control may also be provided for adjusting the amount of hip turn resistance that is to be applied when the golfer 102 reaches the threshold hip rotation angle. In some implementations, the training aid 100 may include a fifth control that allows the golfer 102 to select one or more modes of feedback, and to adjust feedback parameters. For example, the golfer 102 may activate or deactivate different combinations of feedback, such as resistive feedback, haptic feedback, and/or audible feedback.

In some implementations, the threshold rotation angles for the hips and shoulders may be automatically adjusted, such as by a computer program executing on a microprocessor on the training aid 100. The golfer 102 may program a practice routine, for example, that changes one or more settings of the training aid 100 over time. The threshold shoulder and hip rotation angles may increase after a defined number of swings, as the golfer 102 becomes looser and stretched. For example, the shoulder rotation angle may initially be set at 75 degrees. After 10 practice swings, the angle may be automatically increased to 85 degrees, and after another 10 practice swings may be increased again to 95 degrees. The amount of resistance applied may also be automatically changed over time or over a particular number of practice swings by the golfer 102. In some implementations, the training aid 100 can maintain a log of the peak shoulder and hip rotations of the golfer 102. With each swing, the training aid 100 may detect and record the peak shoulder and hip rotations amounts.

In some implementations, the swing training aid 100 depicted in FIGS. 1A-1C may include an arm extension assembly 150. The arm extension assembly 150 can be worn by the golfer 102 on his or her leading arm. Thus, a right-handed golfer may wear the arm extension assembly 150 on the left arm, whereas a left-handed golfer may wear the arm extension assembly 150 on the right arm. The arm extension assembly 150 may attach to the shoulder strap 114*a* above the leading arm of the golfer 102. In some implementations, the arm extension 150 is comprises of an upper arm strap 119 and an elbow band 121. The upper arm strap 119 can be permanently or removably attached (e.g., via clips, buckles, or hook-and-loop fasteners) to shoulder strap 114*a*. The opposite end of the upper arm strap 119 can be permanently or removably attached to the elbow band 121. The elbow band 121 is adapted is worn over the golfer's elbow and is adapted to stay in place during while the golfer 102 performs a swing. For example, the elbow band 121 is positioned on the user's elbow so as to stretch and provide tension along the upper arm strap 119. Even as tension in the upper arm strap 119 increases during the swinging motion, the elbow band 121 is maintained at the golfer's elbow without sliding up the golfer's arm. In some implementations, to ensure that the elbow band 121 maintains position despite the increasing force caused by tension in the upper arm strap 119, a lower arm strap can be provided (not shown), which extends from the elbow band 121, and is attached at a distal end at or near the golfer's hand. For example, the distal end of the lower arm strap may have a handle that the user grips in his or her palm during the swing, to counteract the tensional forces. Generally, the arm extension assembly 150 provides additional feedback to a user that encourages proper swing mechanics. The golfer 102 may be encouraged to maintain the leading arm straight, without unduly breaking the elbow, during a golf swing motion by feeling the tension in the arm extension assembly 150. The tension in the arm extension assembly 150 can also help the golfer to feel a stronger connection between his or her body rotation during the swing and the arm action during the swing. Golfers sometimes refer to the desirability of keeping one's arms and body connected during a swing. The arm extension assembly 150 can help the golfer 102 to achieve this swing objective.

Figure 2:
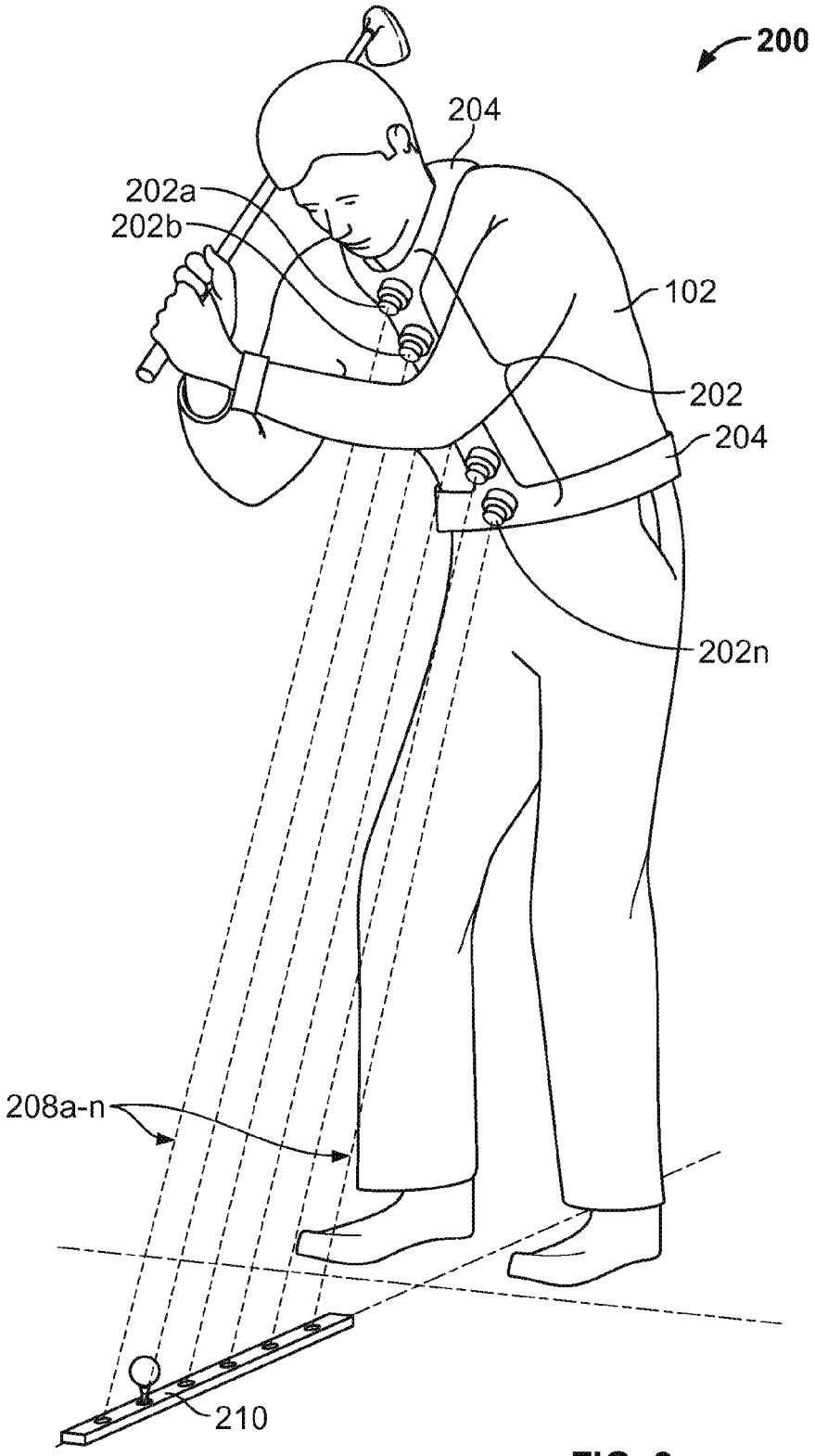
FIG. 2 depicts an example golf training aid that uses a plurality of directed light sources to provide visual indicators of a golfer's setup and swing positions.

Turning to FIG. 2, an example golf training aid 200 is shown that uses a plurality of directed light sources 202*a-n* to provide visual indicators of a golfer's setup and swing positions. The golf training aid 200 shown in FIG. 2 may be used separately from the golf training aid 100 of FIG. 1, or the golf training aids 100, 200 may be used in combination. For example, a golfer 102 may wear the golf training aid 100 (FIG. 1) primarily on his or her back side to receive audible and/or resistive feedback related to his or her hip and shoulder rotation, while also wearing the golf training aid 200 primarily on his or her front side to receive visual feedback related to his setup and swing positions. Generally, any of the various training aids described with respect to FIGS. 1-9 of this document may be compatible with each other, and may be used in combination with those training aids, or separately.

The training aid 200 includes a string of lights 202*a-n*, which are attached to a front side of the golfer 102. The lights 202*a-n* are positioned on the golfer 102 so that they direct beams of light 208*a-n* onto a guide strip 210 that has been placed on the ground in front of the golfer 102. The guide strip 210 provides a target for the golfer 102 to aim the beams of light 208*a-n* at that are radiated from lights 202*a-n*. The guide strip 210 can be positioned on the ground in a manner that matches the arrangement of lights 208*a-n* on the golfer 102, so that when the golfer 102 is in a proper position, the lights 208*a-n* shine along the guide strip 210. When the lights are not directed onto the guide strip 210, this can indicate to the golfer 102 that he or she is in an improper position. For example, the arrangement of lights 202*a-n* running down the front center of the golfer 102 in FIG. 2 can help the golfer 102 to setup in a proper position, with the ball centered in the golfer's 102 stance and the golfer 102 square to the target to which the golfer 102 intends to hit the ball.

The string of lights 202*a-n* can be attached to a harness 204 that the golfer 102 wears while performing a golf swing. In order to locate the lights 202*a-n* in the proper position, the harness may fit securely to the golfer 102 in various ways, so that the lights 202*a-n* remain substantially fixed in position with respect to the golfer 102 during a swing. The harness 204 shown in FIG. 2, for example, includes a neck portion that fits around the golfer's 102 neck, and a waist portion that extends around the golfer's 102 waist. The neck and waist portions hold each end of the string of lights 202 in a substantially fixed position. Other harness configurations may also be employed that secure the string of lights 202*a-n* to the golfer 102 in a substantially fixed position. The harness may also be flexible and elastic, so that it may stretch and bend as required for the golfer 102 to make an unencumbered swing.

In some implementations, the lights 202*a-n* may be removably attached to the harness 204, such as with fabric hook and loop fasteners (e.g., VELCRO) or with snap buttons. In this way, different strings of lights may be swapped from the harness 204, or the string of lights 202*a-n* may be moved and attached to a different portion of the golfer 102 (e.g., knees, arms, shoulders). In some implementations, the lights 202*a-n* may be attached directly to an outer surface of the golfer 102, without the use of a harness 204. For example, pins may secure the string of lights to the golfer's 102 clothing.

The lights 202*a-n* can be arranged to project focused beams 208*a-n* onto the ground. In some implementations, the lights 202*a-n* are adapted to focus their beams on sufficiently small and distinct areas (e.g., 0.25-0.5 inch diameter areas) on the ground that allows the golfer 102 to readily discern whether the lights 202*a-n* have properly lined up on the guide strip 210, or have instead missed the target. The lights 202*a-n* may be implemented as lasers, light emitting diodes (LED), or other suitable types of light sources.

Figure 3:
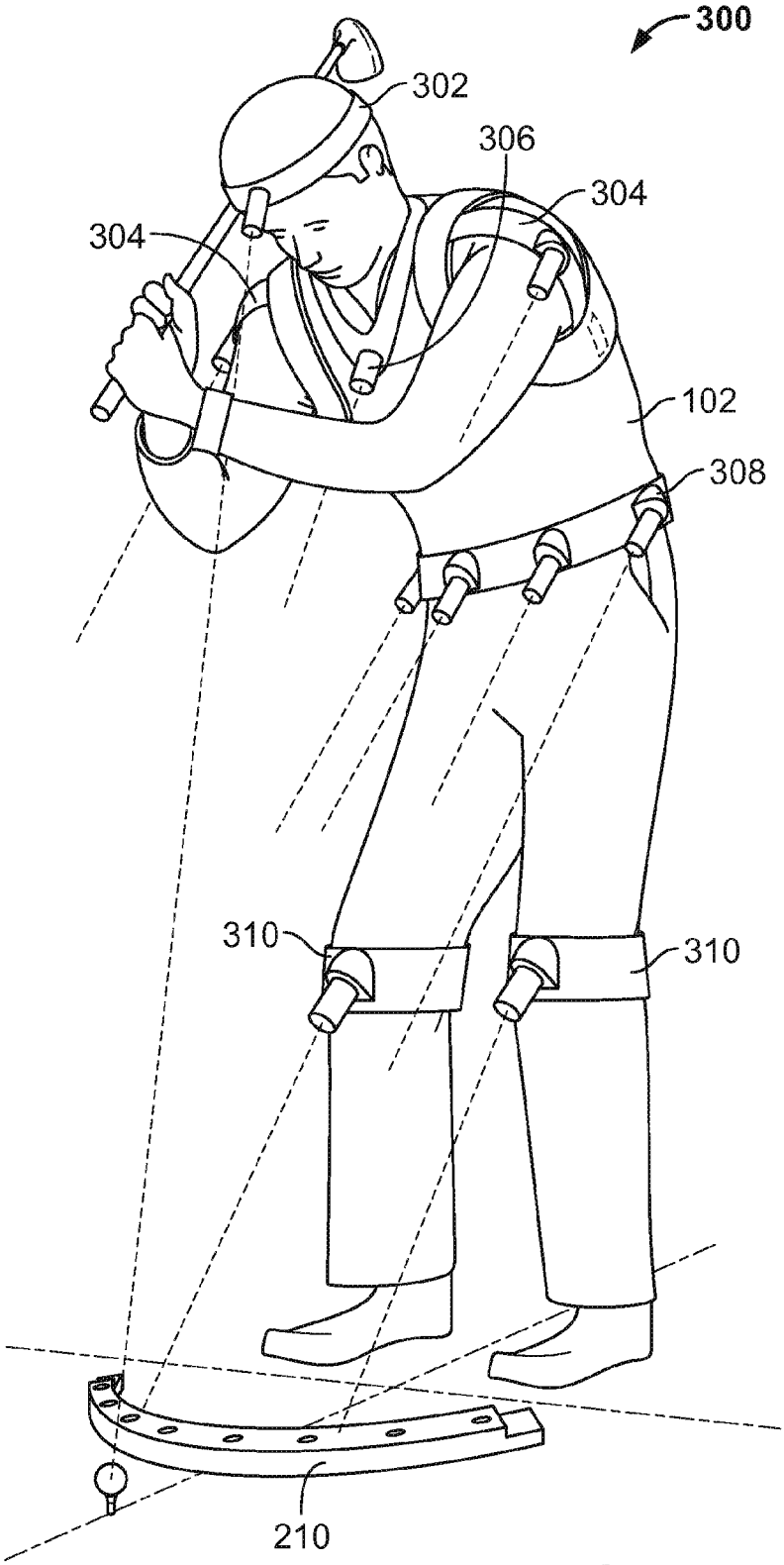
FIG. 3 depicts an example golf training aid having multiple light sets worn by a golfer at different body locations.

In some implementations, multiple sets of lights may be adorned by a golfer at the same time to monitor different aspects of a golf swing. FIG. 3 depicts an example golf training aid 300 having multiple light sets worn by a golfer 102 at different body locations. The golf training aid 300 includes a head light 302, shoulder lights 304, chest light 306, waist lights 308, and knee lights 310. Each of the different light sets may include a single light or a string of multiple lights. In some implementations, the orientation of each light may be adjustable so that the radiated light is directed in the desired direction toward a target location on the ground. In some implementations, different sets of lights may be targeted to different locations on the ground. For example, the head light 302 may be directed toward the golf ball, while the knee lights 310 may be directed toward guide strip 210. Additional guide strips or other markers may be provided on the ground region in front of the golfer 102 as targets for other sets of lights. The golfer 102 may line up one or more of the light sets to establish a mechanically sound stance and setup position. In some implementations, one or more light sets can be adapted to follow a marked path on the ground as the user executes a golf swing. By tracing pre-defined paths with one or more light sets, the golfer 102 may practice a consistent golf swing that promotes desirable swing mechanics. The paths may be custom-tailored to individual golfers in some implementations. For example, the golfer 102 may work on minimizing lateral head motion during a swing by ensuring that the head light 302 stays pointed within a target region on the ground during the swing.

In some implementations, the individual light sets 302-310 may be modular, so that the golfer 102 can adjust each set to be worn on different parts of the body. For example, waist lights 308 may be disposed on an adjustable strap that could be adjusted to run along the golfer's arm or chest at the golfer's choosing. Similarly, the shoulder lights 304 may be adjusted for use as knee lights 310, and one of the knee lights 310 may be adjusted to fit around the golfer's head as head light 302, for example. In some implementations, each set of lights may have a different color. For example, the waist lights 308 may be comprised of blue LEDs, whereas the knee lights 310 may be comprised of red LEDs. The different colored lights can aid the golfer 102 in differentiating which lights are arranged to match with which targets on the ground.

Figure 4A:
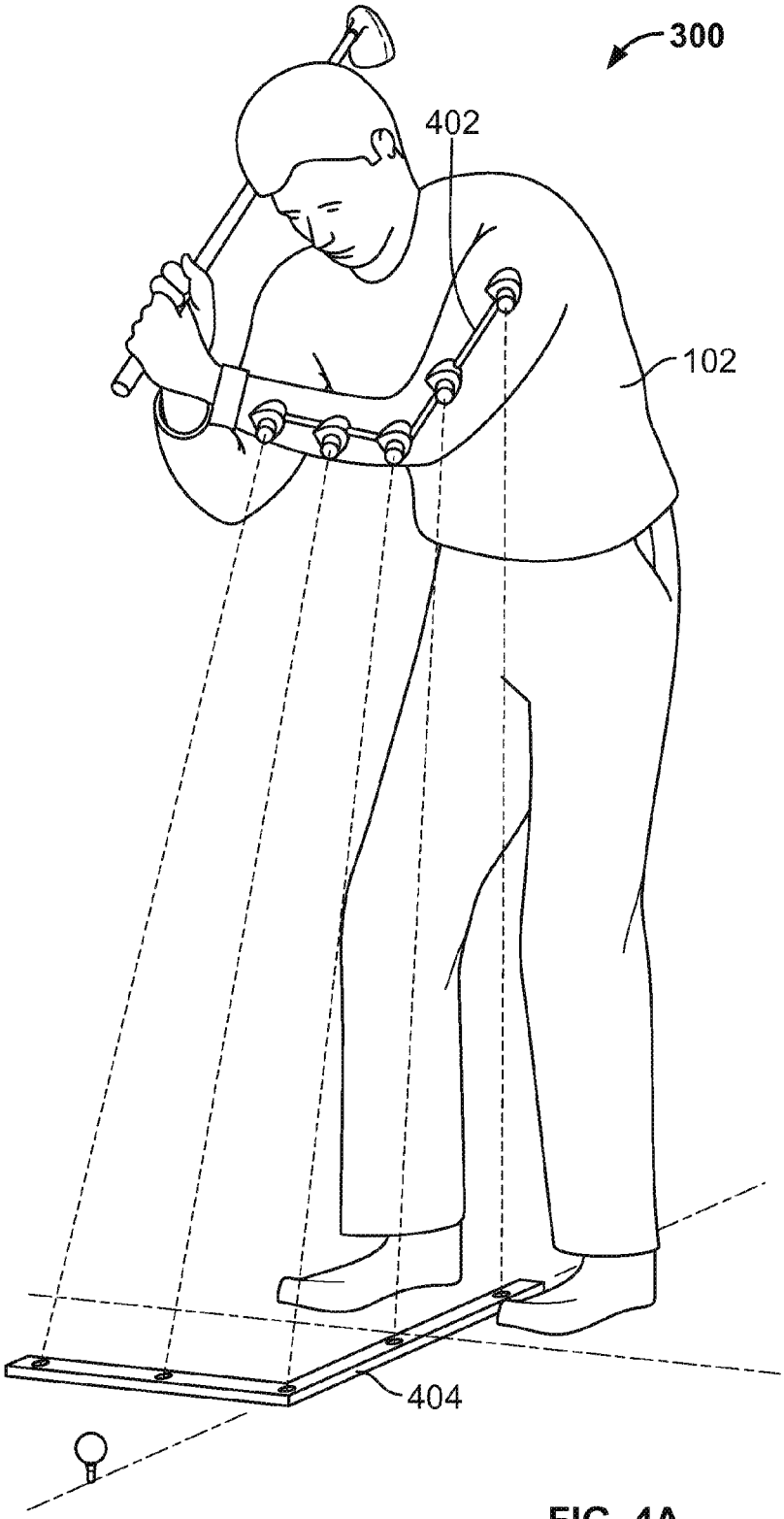
FIGS. 4A and 4B depict additional light sets that the golfer may wear with various training aids.
Figure 4B:
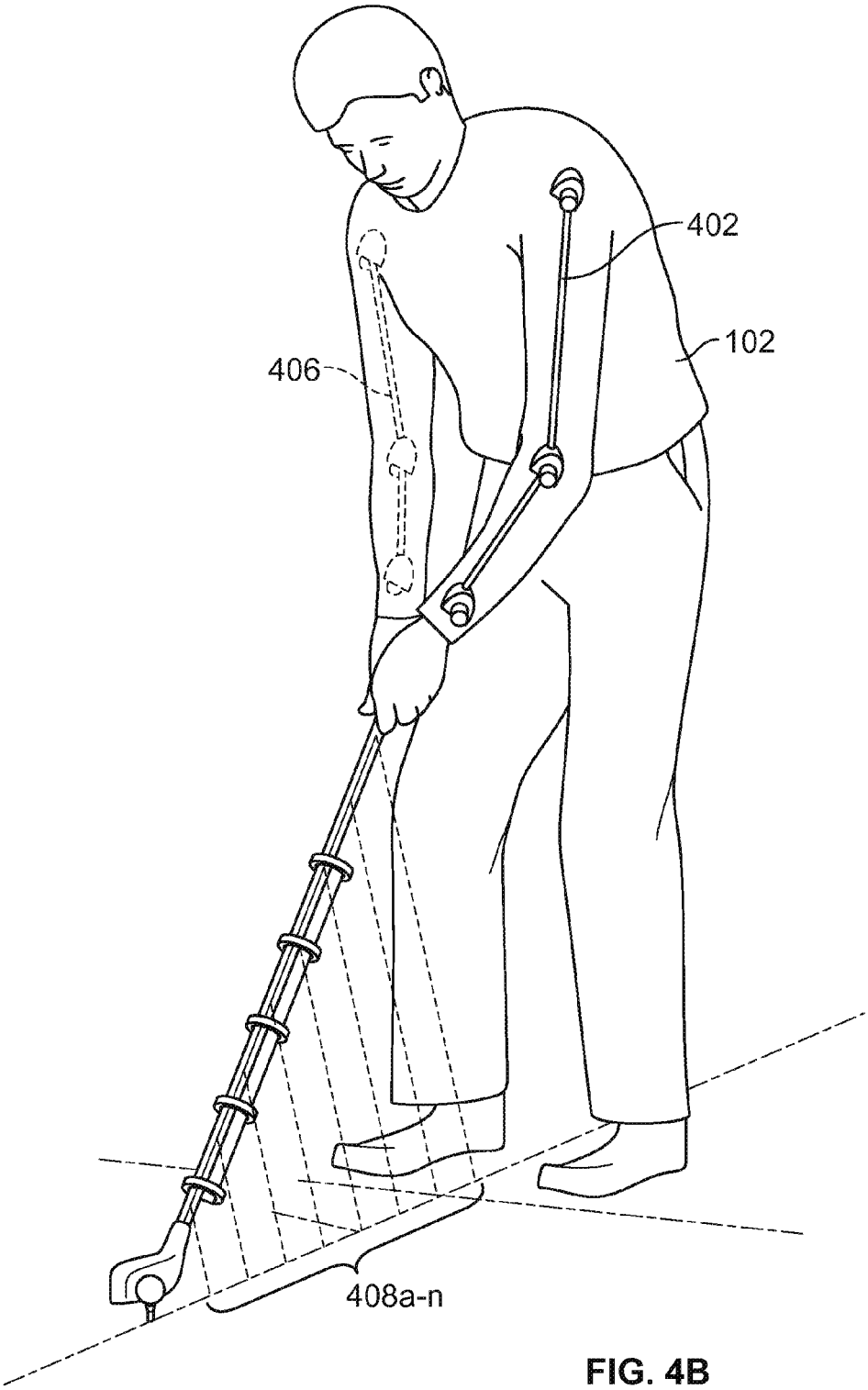

FIGS. 4A and 4B depict additional light sets that the golfer 102 may wear with the example training aids 200 and 300, or with other training aids described in this document. Light set 402 extends along the golfer's 102 leading arm (i.e., left arm for a right-handed golfer, or right arm for a left-handed golfer). During a swing, the golfer 102 can observe projections of the string of lights 402 fixed to the leading arm, to verify whether the leading arm bends during the swing, or is maintained substantially straight as may be desired to achieve optimal swing mechanics. For example, the L-shape formed by projections 404 of lights 402 indicate that the golfer 102 has bent his or her arm during the backswing. The golfer 102 can then work on correcting his or swing to maintain the leading arm in a straighter position. FIG. 4B shows that the golfer 102 may also wear a set of lights 406 on his or her trailing arm, and may attach another set of lights along the shaft of the golf club.

Figure 5:
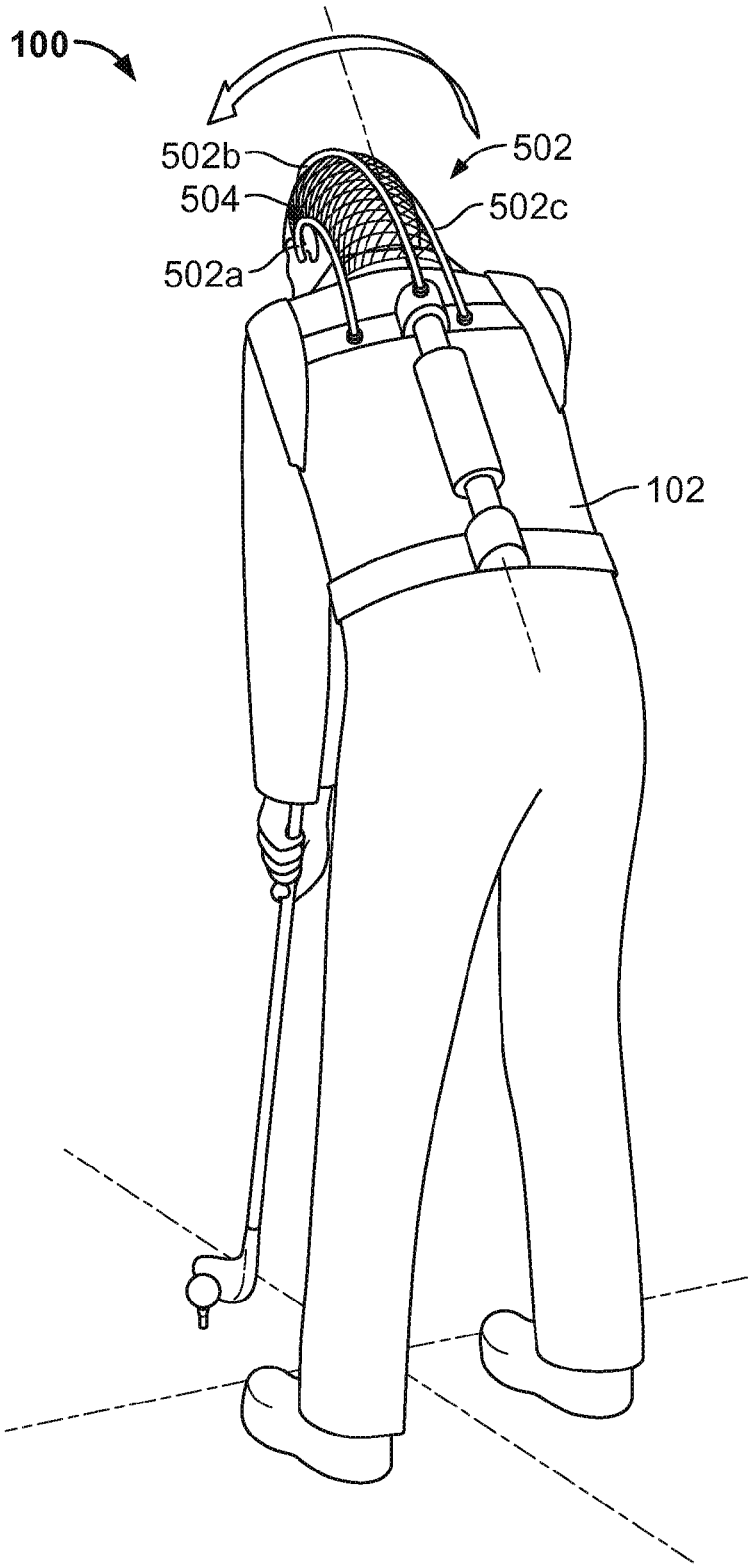
FIG. 5 shows an example head restriction device that may be attached to the swing training aids described herein, and worn by the golfer while performing a golf swing to maintain the head in a proper position.

FIG. 5 shows a headpiece 502 that may be attached to training aid 100, and worn by the golfer 102 while performing a golf swing. The headpiece 502 can act as a restriction device that ensures that the golfer 102 aligns his or her head in a proper position during setup while addressing the ball before a swing, and can also prevent the golfer 102 from unduly moving his or her head out of position (e.g., laterally or vertically) during the swing. In some implementations, the headpiece 502 includes hooks that are received in corresponding slots within the shoulder harness 104 to hold the headpiece 502 in place. The headpiece 502 may be removably connected so that the golfer 102 can choose whether to practice with or without the headpiece 502. A plurality of extensions 502*a-c* (guide elements) may extend up and around the head of the golfer 102. The extensions 502*a-c* are maintained in a fixed position and are arranged to hold the golfer's 102 head within its bounds. Thus, extension 502*a* is held closely to the left side of the golfer's 102 head, extension 502*b* is held closely to the top-center of the golfer's 102 head, and extension 502*c* is held closely to the right side of the golfer's 102 head, preventing the golfer from moving his or her head too far left, up, or right, respectively. In some implementations, the extensions 502*a-c* may be formed from malleable wires that may be adjusted to contour closely to the head. A lightweight fabric, mesh, or web material may be attached between the extensions 502*a-c* for additional support. Fewer or additional extensions may be provided in the headpiece 502, in some implementations.

Figure 6:
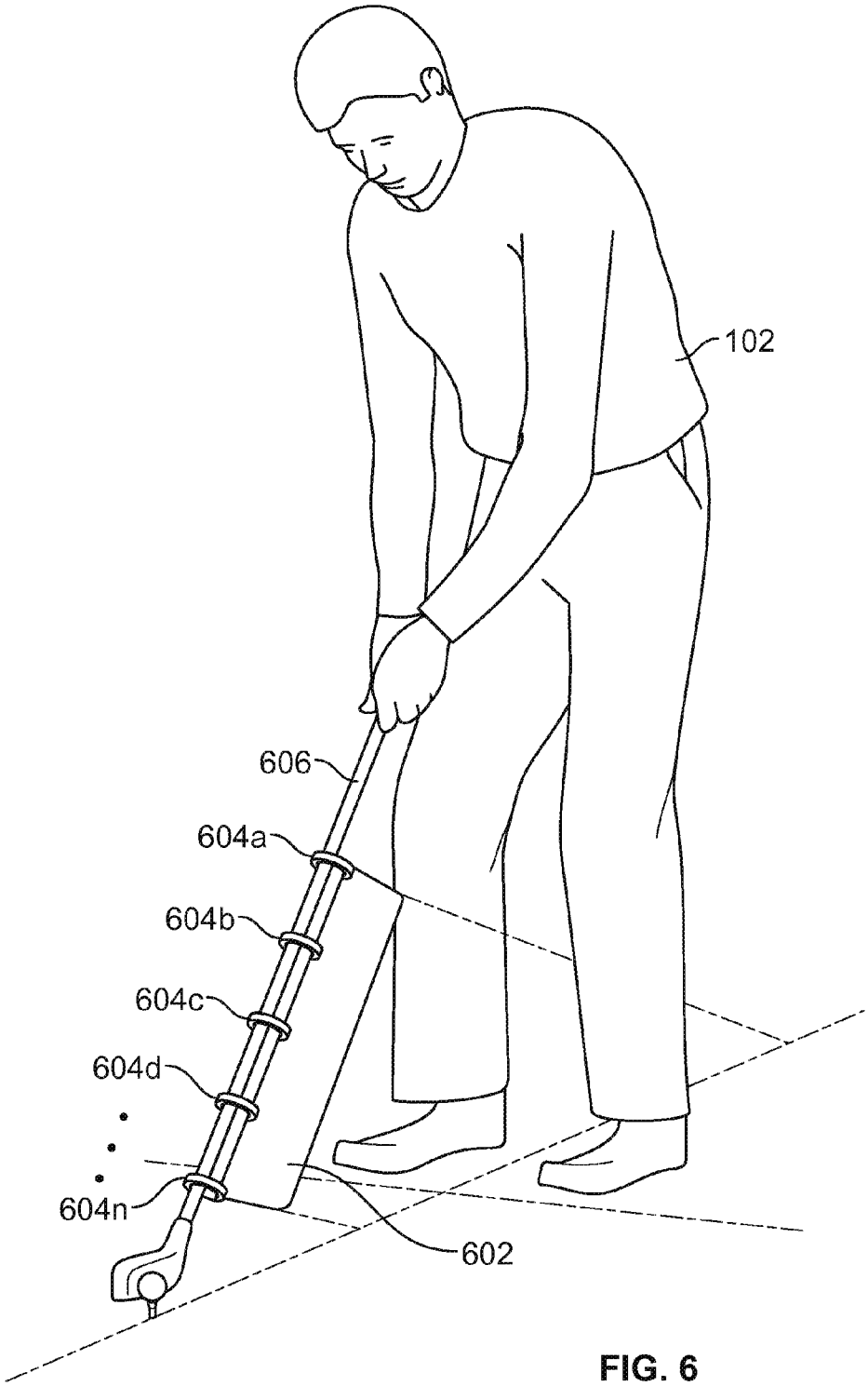
FIG. 6 depicts an example swing fin device for training proper positions and motions of a golf swing.

FIG. 6 depicts an example swing fin device 602 for training proper positions and motions of a golf swing. The swing fin 602 can be made of a substantially flat material, and can be adapted for connection to the underside of a golf club 606 along the shaft of the club 606. In some implementations, the swing fin 602 may be removably attached to the club using one or more connectors 604*a-n*. The connectors 604*a-n* may be snap connectors or clamps that fit around the club shaft and that hold the swing fin 602 in a fixed position on the club 606. The swing fin 602 may be made of a lightweight material, such as extruded plastic. In some implementations, the length of the swing fin 602 may be about 12-30 inches, depending on the length of clubs to which it will be connected, and may be about 6-12 inches wide, and up to about 0.5 inches thick. When attached to the club 606, the swing fin 602 can serve to indicate to the golfer 102 the orientation of the club face throughout different stages of the swing. For example, as the user begins the takeaway of the club 606 to initiate the backswing, the toe of the clubface should begin pointing upward, and thus the fin 602 should point down toward the ground. At the peak of the backswing, the golfer 102 may check that the fin 602 is pointing upward to ensure that the toe of the clubface points down (i.e., that the clubface is square and not too far open or shut at the top of the swing). In some implementations, the swing fin 602 can be used in combination with other portions of the swing training aids described herein. In some implementations, the swing fin 602 may be used on its own.

Figure 7:
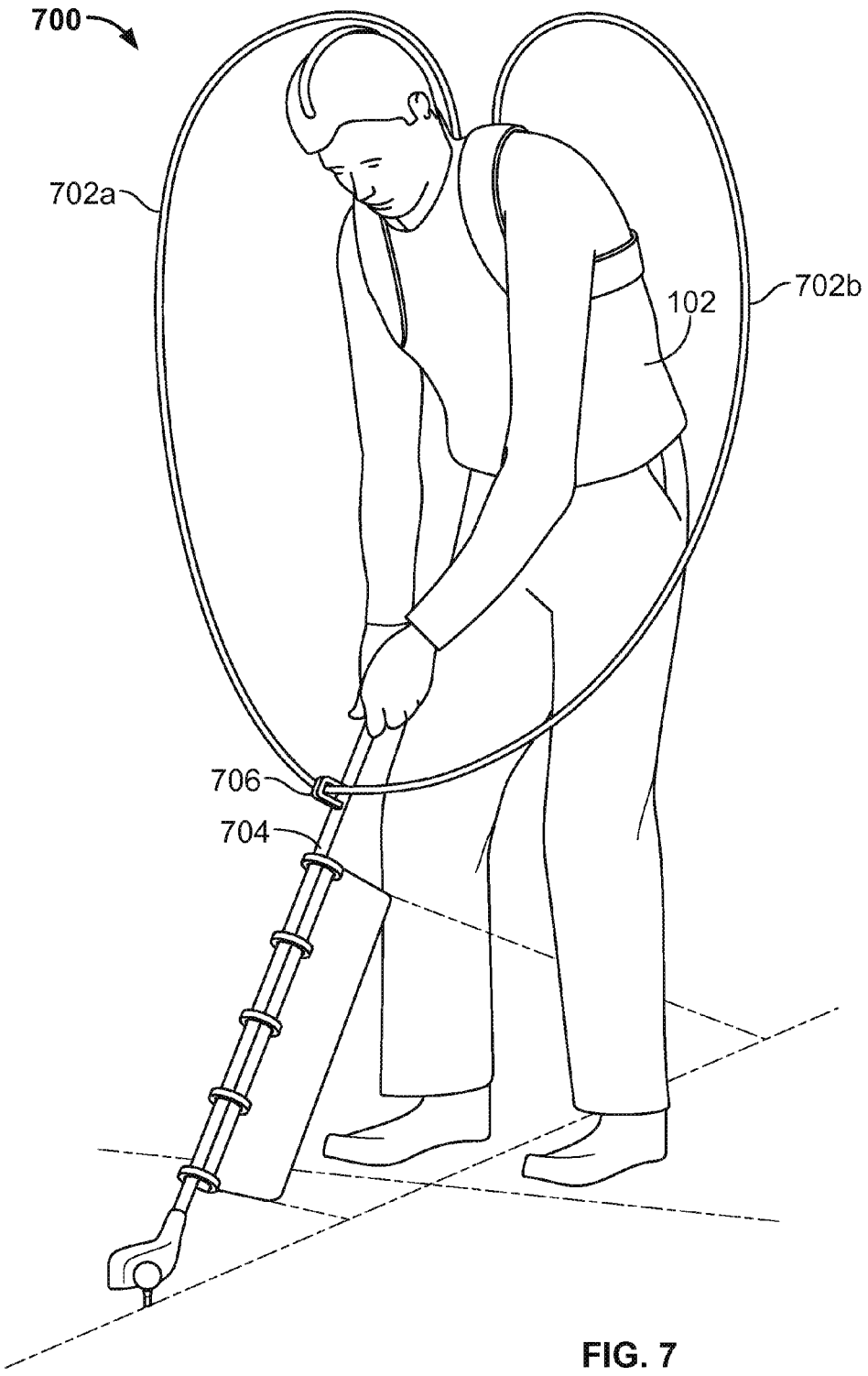
FIG. 7 shows an example swing plane trainer for facilitating a swing path along a desired plane.

FIG. 7 shows an example swing plane trainer 700 for facilitating a swing path along a desired plane. The trainer 700 can include one or more elongate plane guides 702*a, b* that extend along a curvilinear path from the back of the golfer 102 to a location at an upper portion of the shaft of golf club 704. For example, the example plane trainer 700 depicted in FIG. 7 includes a first plane guide 702*a* that curves around the golfer's right side, and a second plane guide 702*b* that curves around the golfer's left side. Each plane guide 702*a-b* is secured at one end to the back of the golfer 102, such as by a hook that attaches to a shoulder harness worn by the golfer (not shown in FIG. 7). In some implementations, a hook 706 may be attached to the shaft of the club 704. The hook 706 may loop around the plane guides 702, allowing the club 706 to swing along the path formed by the plane guides 702. The plane guides 702 may be connected at positions on the back of the golfer 102, and on the club 706, so as to create a swing plane at a desired angle. The angle may be adjustable, which the golfer 102 or his or her instructor may select. The trainer 700 can be adapted for use with the swing training aids described throughout this document. For example, the plane guides 702 may connect to shoulder harness 104 of swing training aid 100 (FIG. 1).

Figure 8:
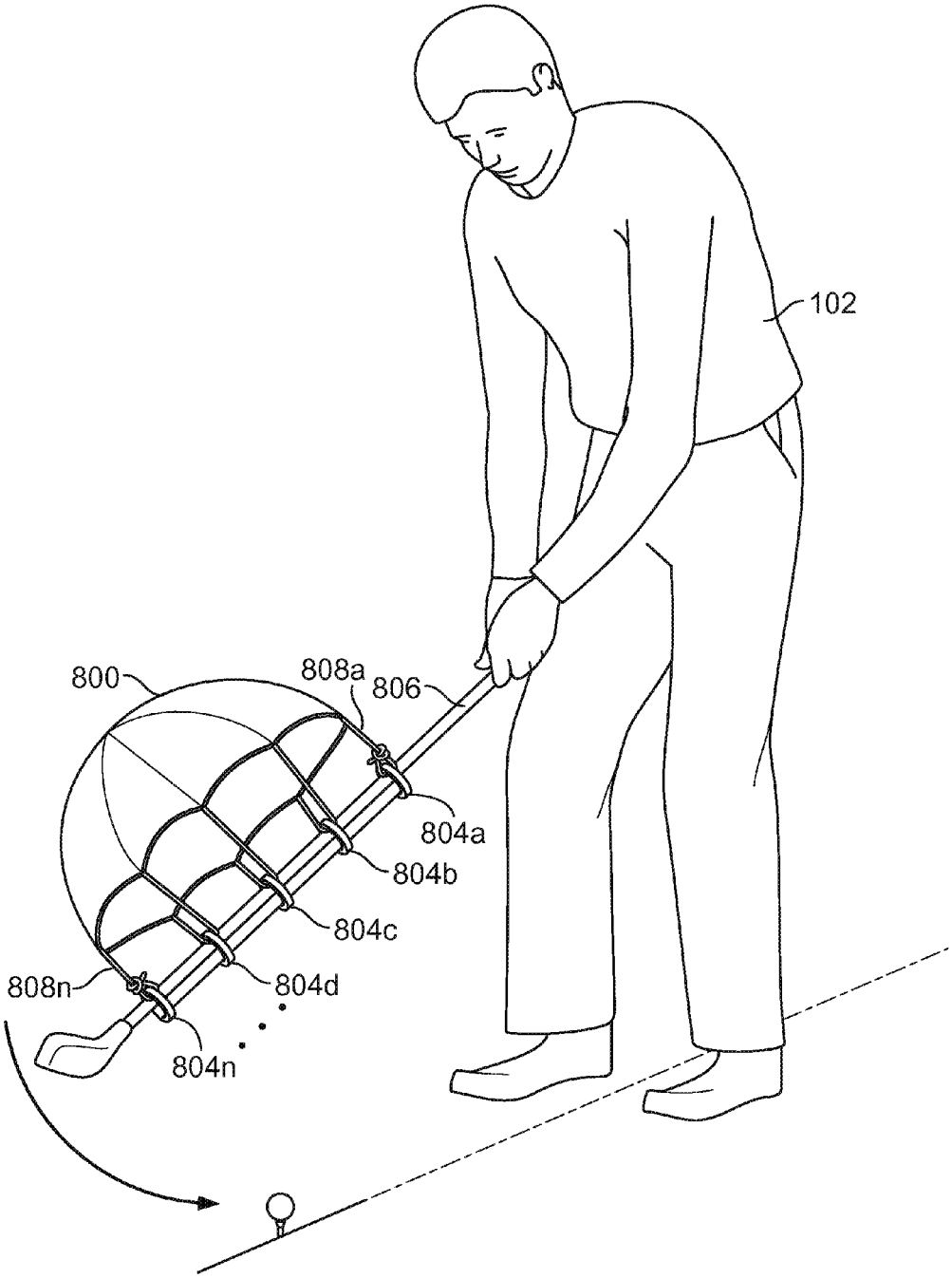
FIG. 8 depicts an example swing training aid that employs a parachute connected to the golf club for generating air resistance during a golf swing.
Figure 9:
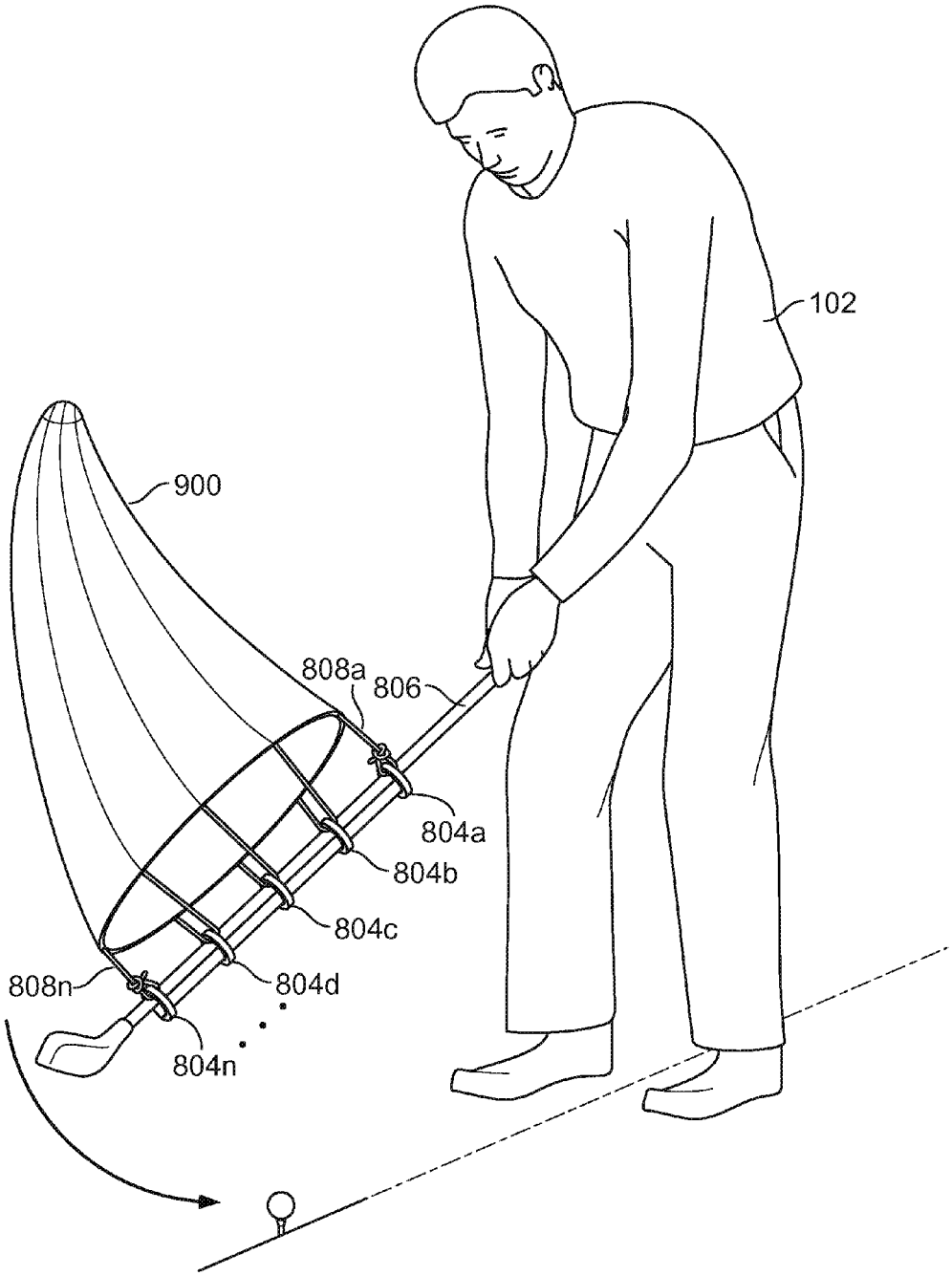
FIG. 9 depicts an example swing training aid that employs a wind sock connected to the golf club for generating air resistance during a golf swing.

FIGS. 8 and 9 illustrate additional training aids that may be employed to encourage desirable golf swing mechanics. FIG. 8 shows a golfer 102 in a downswing motion with a golf club 806 to which a parachute 800 is attached. FIG. 9 shows the golfer 102 in a downswing motion with a golf club 806 to which a wind sock 900 is attached. The parachute 800 and wind sock 900 are each attached to the golf club 806 so as generate resistance during the golfer's down swing. The resistance is generated by catching air in the parachute 800 or wind sock 900 during the down swing. The faster the golfer 102 swings, the greater resistance that he or she will encounter. In this way, the golfer can learn to swing with greater power. Repeated swings with the parachute 800 or wind sock 900 training assemblies can allow the golfer 102 to train the many muscles large and small that are involved in a full golf swing. In some implementations, as shown in FIGS. 8 and 9, the parachute 800 and wind sock 900 can be secured to the golf club 806 by way of a series of cords 808*a-n* that attach to corresponding attachments points 804*a-n* along the shaft of the golf club 806. The attachment points 804*a-n* may be spaced and fixed at particular positions along the length of the shaft. In some implementations, the attachment points are annular rings that fit around the shaft of the golf club 806. The annular rings may be secured within a channel or groove in the club shaft, or may be welded to the shaft. The rings may further have an additional small aperture through which the cords from the parachute 800 or wind sock 900 are looped through. The length of the cords may also be adjustable, to change how closely the opening of the parachute 800 or wind sock 900 is spaced from the shaft of the golf club 806. The parachute 800 has a substantially semi-spherical shape, and is closed at the distal end of the parachute 800. The wind sock 900 can be more elongated than the parachute 800, and can have a second opening at the distal end of the wind sock 900 to allow some air to escape. The larger the second opening at the distal end of the wind sock 900 is made to be, generally the less resistance that the wind sock 900 will generate. In some implementations, a draw string may be provided around the perimeter of the second opening, which allows the user to adjust the size of the second opening to increase or decrease the amount of resistance generated by the wind sock 900. When the second opening is completely closed by the drawstring, the maximum amount of resistance can be generated.

A number of embodiments have been described. Nevertheless, it will be understood that various modifications may be made without departing from the spirit and scope of that which has been explicitly described. Accordingly, other embodiments are within the scope of the following claims.

What is claimed is:

1. A golf training aid comprising:

a shoulder harness adapted to extend laterally across an upper back of a wearer of the golf training aid from a left shoulder of the wearer to a right shoulder of the wearer;

a waist harness adapted to extend laterally across a lower back of the wearer from a left side of the wearer to a right side of the wearer;

a torsion bar adapted to extend vertically from the upper back to the lower back of the wearer of the golf training aid;

a shoulder turn regulator connected to a first portion of the torsion bar, the shoulder turn regulator adapted to resist rotation of the shoulders of the wearer of the golf swing training aid beyond a threshold shoulder rotation amount during a backswing motion of the wearer; and a hip turn regulator connected to a second portion of the torsion bar, the hip turn regulator adapted to resist rotation of the hips of the wearer of the golf swing training aid beyond a threshold hip rotation amount during the backswing motion of the wearer.

2. The golf training aid of claim 1, wherein the torsion bar comprises a first portion and a second portion, the first portion of the torsion bar adapted to rotate in conjunction with rotation of the shoulders of the wearer, the second portion of the torsion bar adapted to rotate in conjunction with rotation of the hips of the wearer, the first and second portions arranged to rotate separately from each other.

3. The golf training aid of claim 2, wherein:

the first portion of the torsion bar comprises a first elongated tube or rod, the second portion of the torsion bar comprises a second elongated tube or rod, the torsion bar further comprises an outer tube adapted to receive the first elongated tube or rod and the second elongated tube or rod at respective ends of the outer tube, and the first elongated tube or rod and the second elongated tube or rod are each rotatably coupled to the outer tube.

4. The golf training aid of claim 1, wherein the shoulder harness comprises a substantially rigid bar adapted to extend across the upper back of the wearer of the golf training aid.

5. The golf training aid of claim 4, wherein the rigid bar of the shoulder harness is shaped to arc across the upper back of the wearer of the golf training aid.

6. The golf training aid of claim 1, wherein the waist harness comprises a substantially rigid bar adapted to extend across the lower back of the wearer of the golf training aid.

7. The golf training aid of claim 6, wherein the rigid bar of the waist harness is shaped to arc along the lower back of the wearer golf training aid.

8. The golf training aid of claim 1, wherein the shoulder turn regulator is adapted to resist rotation of the shoulders of the wearer of the golf training aid beyond a threshold shoulder rotation amount in a range substantially of 80 to 110 degrees from an initial setup position.

9. The golf training aid of claim 8, wherein the shoulder turn regulator includes a user-selectable control adapted to adjust the threshold shoulder rotation amount to a particular amount within the range based on user input.

10. The golf training aid of claim 1, wherein the hip turn regulator is adapted to resist rotation of the hips of the wearer of the golf swing training aid beyond a threshold hip rotation amount in a range of substantially 25 to 45 degrees from an initial setup position.

11. The golf training aid of claim 10, wherein the hip turn regulator includes a user-selectable control adapted to adjust the threshold hip rotation amount to a particular amount within the range based on user input.

12. The golf training aid of claim 1, wherein the hip turn regulator is adapted to resist rotation of the hips of the wearer of the golf training aid beyond a first angle, the shoulder turn regulator is adapted to resist rotation of the shoulders of the wearer of the golf training aid beyond a second angle, and the first angle is substantially ten degrees less than the second angle.

13. The golf training aid of claim 1, wherein the shoulder turn regulator is adapted to generate haptic feedback or audible feedback to the wearer of the golf training aid as a result of the wearer rotating the shoulders beyond the threshold shoulder rotation amount.

14. The golf training aid of claim 1, wherein the hip turn regulator is adapted to generate haptic feedback or audible feedback to the wearer of the golf training aid as a result of the wearer rotating the hips beyond the threshold hip rotation amount.

15. The golf training aid of claim 1, further comprising one or more light sets adapted to be worn by the wearer of the golf training aid while performing a golf swing, wherein each of the one or more light sets includes at least one light source arranged (i) to direct light to a particular location on a ground surface around the wearer that indicates the wearer is in a proper setup position for the golf swing, and (ii) to direct light along a pre-defined path of the ground surface during performance of the golf swing, wherein the pre-defined path is arranged to encourage proper swing mechanics of the wearer.

16. The golf training of claim 15, wherein a first light set of the one or more light sets comprises a string of multiple light emitting diodes (LEDs) or lasers, spaced over a distance and adapted to be attached to an outer surface of the wearer of the golf training aid.

17. The golf training aid of claim 15, wherein different ones of the one or more light sets comprise light sources having visibly different colors, so as to allow the wearer to distinguish among different light sets based on the respective colors of the light sources.

18. The golf training aid of claim 15, wherein a first light set of the one or more light sets is adapted to fit around a knee of the wearer, along a clavicle of the wearer, around a head of the wearer, or around the waist area of the wearer during performance of a golf swing.

19. The golf training aid of claim 18, wherein a second light set of the one or more light sets is adapted to attach along a shaft of a golf club, along a leading arm of the wearer, or along a trailing arm of the wearer during performance of a golf swing.

20. The golf training aid of claim 1, further comprising a head restriction device adapted to be worn during execution of a golf swing by the wearer to maintain the head of the wearer in proper position during the execution of the golf swing, the head restriction device including a first guide element shaped to curve over a top of the wearer's head, a second guide element shaped to curve around a left-side of the wearer's head, and a third guide element shaped to curve around a right-side of the wearer's head.

21. The golf training aid of claim 1, further comprising a swing plane guide having a first end and a second end, the first end adapted to connect to a shaft of a golf club, the second end adapted to connect to a structure on the back of the wearer, wherein the structure on the back of the wearer is positioned so that the swing plane guide defines a golf swing plane.

22. The golf training aid of claim 1, further comprising a parachute or a wind sock connected to a portion of a golf club and arranged so as to generate resistance during a downswing motion of the golf club by catching air within a cavity of the parachute or the wind sock.

* * * * *